US008578912B2

(12) United States Patent
Schumacher et al.

(10) Patent No.: US 8,578,912 B2
(45) Date of Patent: Nov. 12, 2013

(54) METHOD AND DEVICE FOR CONTROLLING AN AFTERGLOW TEMPERATURE IN A DIESEL COMBUSTION ENGINE

(75) Inventors: Herbert Schumacher, Gerlingen (DE); Christos Hondros, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 912 days.

(21) Appl. No.: 12/598,813

(22) PCT Filed: Jun. 3, 2008

(86) PCT No.: PCT/EP2008/056824

§ 371 (c)(1), (2), (4) Date: Nov. 4, 2009

(87) PCT Pub. No.: WO2009/000614

PCT Pub. Date: Dec. 31, 2008

(65) Prior Publication Data

US 2010/0126464 A1 May 27, 2010

(30) Foreign Application Priority Data

Jun. 28, 2007 (DE) ..... 10 2007 029 912
Sep. 14, 2007 (DE) ..... 10 2007 044 003

(51) Int. Cl.
*F02D 41/08* (2006.01)
*F23Q 7/00* (2006.01)

(52) U.S. Cl.
USPC ..... 123/491; 123/145 A; 123/339.24

(58) Field of Classification Search
USPC ..... 123/145 A, 145 R, 349, 350, 435, 549, 123/179.5, 27 R, 179.6, 491; 701/104, 113; 219/262, 263, 268
See application file for complete search history.

(56) References Cited

U.S. PATENT DOCUMENTS

| | | | | |
|---|---|---|---|---|
| 4,475,492 | A * | 10/1984 | Furukawa et al. | 123/685 |
| 4,478,181 | A | 10/1984 | Kikuchi et al. | |
| 2005/0081812 | A1 * | 4/2005 | Toedter et al. | 123/145 A |
| 2008/0163840 | A1 | 7/2008 | Toedter et al. | |
| 2008/0210186 | A1 * | 9/2008 | Stoller | 123/145 A |
| 2009/0194070 | A1 * | 8/2009 | Dittus et al. | 123/406.55 |

FOREIGN PATENT DOCUMENTS

| | | |
|---|---|---|
| DE | 31 31 191 | 2/1983 |
| DE | 35 02 966 | 12/1985 |
| DE | 44 03 029 | 8/1996 |
| EP | 1 852 604 | 11/2007 |
| JP | 59-18275 | 1/1984 |
| JP | 59 108877 | 6/1984 |
| JP | 5-113167 | 5/1993 |

* cited by examiner

*Primary Examiner* — Willis R Wolfe, Jr.
*Assistant Examiner* — Johnny Hoang
(74) *Attorney, Agent, or Firm* — Kenyon & Kenyon LLP

(57) ABSTRACT

A method and a device for setting an afterglow temperature in a self-igniting internal combustion engine, the afterglow temperature being reduced in a defined operating state of the internal combustion engine until a modification of an operating parameter as a result of the reduction of the afterglow temperature is required in order to maintain the defined operating state, in particular in order to maintain the injected fuel quantity.

7 Claims, 2 Drawing Sheets

METHOD AND DEVICE FOR CONTROLLING AN AFTERGLOW TEMPERATURE IN A DIESEL COMBUSTION ENGINE

FIELD OF THE INVENTION

The present invention relates to a method and a device for controlling a heating pin/glow plug in a Diesel engine, in order to control the afterglow temperature.

BACKGROUND INFORMATION

Self-igniting internal combustion engines are usually equipped with heating pins to facilitate the ignition of a fuel-air mixture inside the combustion chamber in a cold start. The control of the heating pin continues even immediately following a startup of the engine, until the engine has heated up sufficiently so that the ignition may take place automatically without any additional heating of the air-fuel mixture.

At present, once the engine has been started, the heating pins are adjusted with the aid of a characteristics map, as a function of the cooling water temperature, the atmospheric pressure of the environment, and as a function of the number of engine cycles following the startup of the engine. However, the optimum afterglow temperature depends on the quality of the fuel used, the vehicle model in which the internal combustion engine is installed, and on constructional tolerances of the engine such as the clearance between the fuel jet injected into the combustion chamber of the engine, and the heating pin.

The glow temperature to which the heating pin is heated has a considerable effect on the service life of a heating pin.

Therefore, following the engine start, the glow temperature is usually reduced according to the mentioned characteristics map in an effort to extend the service life of the heating pin. Since the characteristics map must take into account possible constructional tolerances of the engine, different fuel qualities and different types of motor vehicles in which the engine is installed, in some internal combustion engines the afterglow temperature of the heating pin tends to be set higher than actually required for the proper course of combustion process, the adjustment being made via the characteristics map.

SUMMARY OF THE INVENTION

Therefore, it is an object of the exemplary embodiments and/or exemplary methods of the present invention to provide a method and a device by which an afterglow temperature in a self-igniting internal combustion engine is able to be set in such a way that the service life of the heating pin is prolonged.

This particular objective is achieved by the method and by the device described herein.

Further advantageous developments of the exemplary embodiments and/or exemplary methods of the present invention are further described herein.

According to one aspect, a method for adjusting an afterglow temperature in a self-igniting internal combustion engine is provided. The afterglow temperature is reduced in a defined operating state of the combustion engine until a modification of an operating parameter as a result of the reduction of the afterglow temperature is required in order to maintain the defined operating state, especially in order to maintain the injected fuel quantity, the engine efficiency and/or the engine speed.

Furthermore, the afterglow temperature is able to be adjusted to a maximum afterglow temperature following the startup of the internal combustion engine. The modification of the operating parameter may include an increase in an injected fuel quantity. Also, the afterglow temperature cannot be reduced further once a minimum afterglow temperature has been reached. According to one specific embodiment, the operating parameter is able to be modified as a result of a closed-loop speed control.

In other words, one idea of the exemplary embodiments and/or exemplary methods of the present invention provides for setting the afterglow temperature as a function of the engine behavior in a defined operating point. To this end, starting from a maximally possible (permitted) glow temperature, which is set when starting the engine, for example, the afterglow temperature is reduced following the engine start in the defined operating point of the engine, and it is checked whether or not an operating parameter, e.g., the fuel quantity requested by a closed-loop speed control of the engine, has increased considerably. An additional or alternative parameter to be utilized is the smooth running of the engine. If it is determined that the fuel quantity to be injected has increased and/or that the engine is running less smoothly, then the adjusted afterglow temperature is too low and is increased again accordingly.

If the engine operates satisfactorily even after the glow temperature has been lowered, then the temperature limit required for proper engine operation may be determined, for example by a stepwise further lowering of the glow temperature. Such a method makes it possible to optimally adjust the afterglow temperature to the engine; constructional tolerances of the engine, the fuel quality as well as additional parameters affecting the internal combustion behavior of the engine are automatically taken into account in the adjustment of the afterglow temperature. The service life of the heating plug is prolonged since the afterglow temperature is already continually reduced to an afterglow temperature sufficient for the combustion following the engine startup.

To reset the engine to an optimum operation following an excessive reduction of the afterglow temperature, the afterglow temperature may be increased following a required modification of the operating parameter.

According to one specific embodiment, the modification of the operating parameter may be estimated in that a time gradient of the operating parameter is determined while reducing the afterglow temperature, a required modification of the operating parameter being detected when the gradient exceeds a specific threshold value.

According to one further specific embodiment, a required modification of the operating parameter is detected when an average value of the operating parameter across a specific time interval is greater, or greater by a specific amount, than an average value of the operating parameter across a preceding time interval.

According to one further aspect, a device is provided for setting an afterglow temperature for a self-igniting internal combustion engine. The device includes a glow device, mounted on a cylinder, for providing a glow temperature inside the cylinder, as well as a control device designed to provide an operating parameter or a plurality of operating parameters for operating the internal combustion engine, and for reducing the afterglow temperature in a defined operating state of the internal combustion engine until a modification of the operating parameter as a result of the reduction of the afterglow temperature is required in order to maintain the defined operating state, in particular in order to maintain the injected fuel quantity, the efficiency, and/or the engine speed.

Furthermore, a control device may be designed to provide the operating parameter for operating the internal combustion engine with the aid of a closed-loop speed control.

According to an additional aspect, a computer program product is provided having machine-readable code stored thereon, by which a control device is able to be operated in order to carry out the method described above.

Exemplary embodiments of the present invention are explained in greater detail in the following text on the basis of the attached drawings.

DETAILED DESCRIPTION

Figure 1:
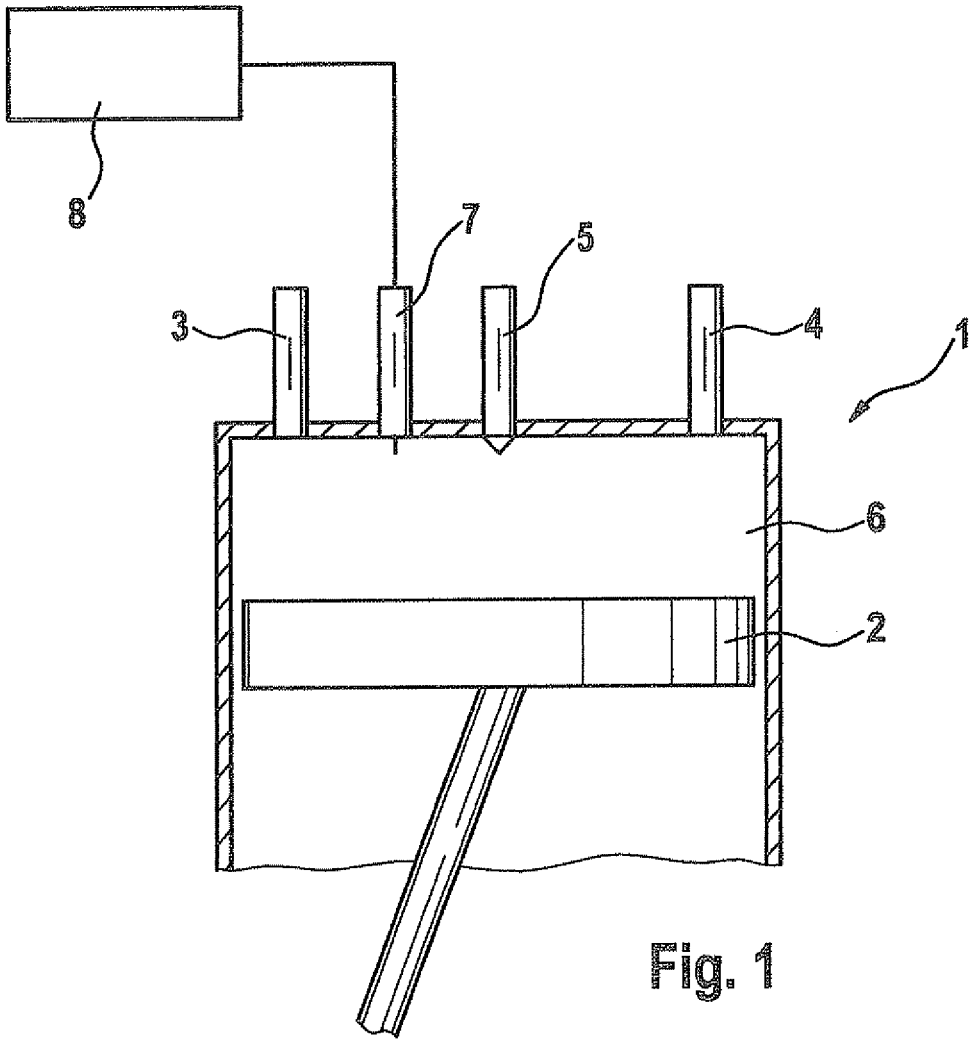
FIG. 1 shows a schematic illustration of a cylinder of a self-igniting internal combustion engine.

FIG. 1 shows a schematic cross-sectional view of a cylinder 1 of a self-igniting internal combustion engine. Cylinder 1 includes a combustion chamber 6 inside which a piston 2 is moving. Air is admitted into combustion chamber 6 via an intake valve 3, and combustion residue is expelled via a discharge valve 4. When the combustion engine is in operation, an injector 5 injects fuel when the air admitted into combustion chamber 6 is in its most compressed state. The fuel-air mixture is ignited when the temperature of the fuel-air mixture is sufficiently high, such as >200° C., for example. To locally raise the temperature of the fuel-air mixture+to a temperature at which an ignition can take place in the startup of the internal combustion engine, a glow device in the form of a heating pin 7 is provided, which is situated on combustion chamber 6 and constitutes a heat source for heating the fuel-air mixture.

The required glow temperature thus is high at the startup of the engine and decreases as the combustion chamber heats up. If the combustion engine is sufficiently heated, glowing may be dispensed with completely, so that heating pin 7 is deactivated following a specific time interval after the startup of the engine.

Heating pin 7 may be a ceramic heating pin exhibiting a maximum glow temperature of 1400° C., for example. The service life of such a heating pin depends considerably on the time period for which the heating pin is operated at such a high temperature. If the glow temperature is reduced, then the overall service life of such a heating pin increases as a result. At temperatures of approximately 900° C., for example, the glow temperature does not have any considerable adverse effect on the service life of heating pin 7. Heating pin 7 is controlled by a control device 8 in that a voltage is applied that corresponds to a specific glow temperature according to a known relationship.

Figure 2:
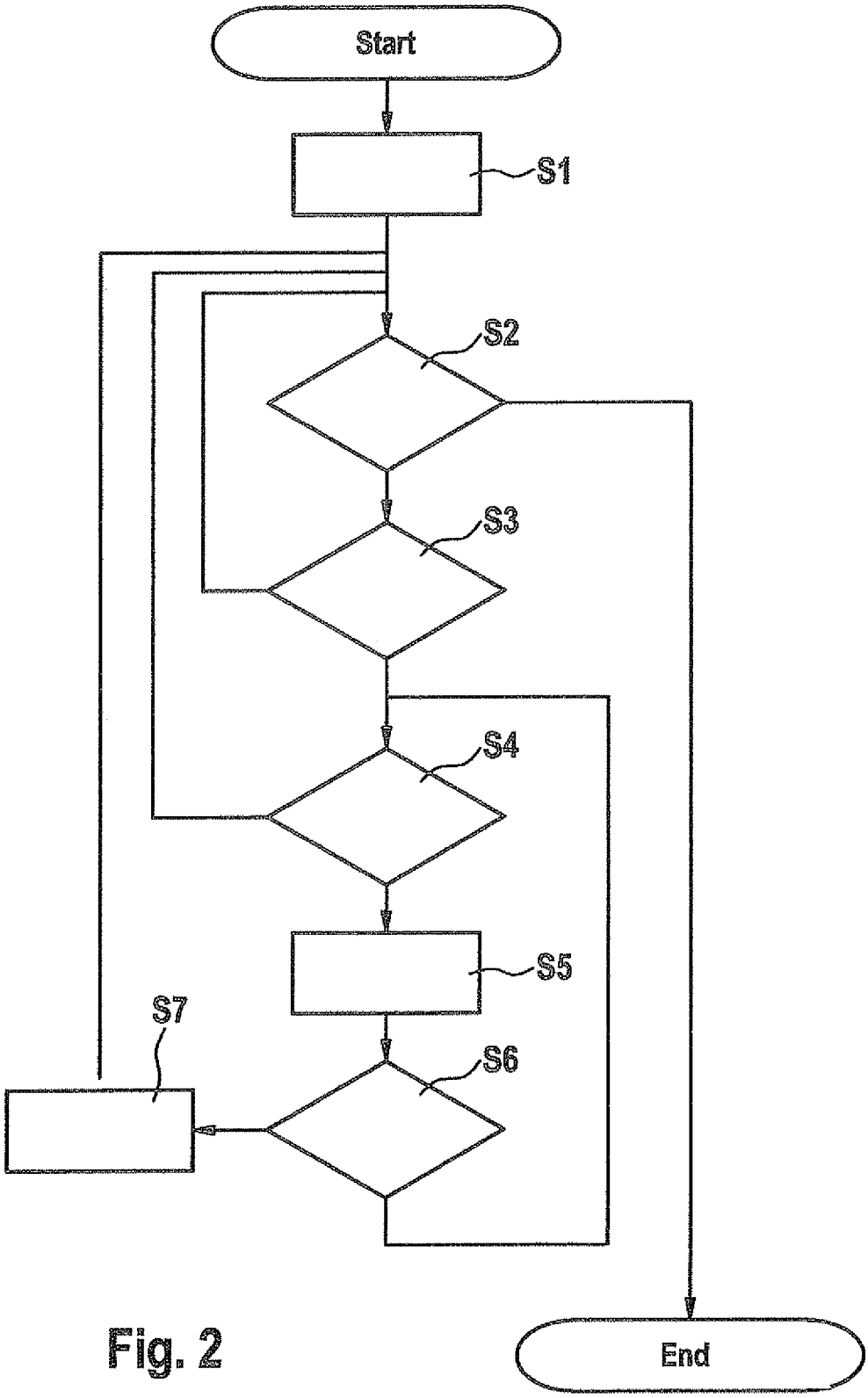
FIG. 2 shows a flow chart to illustrate a specific embodiment of the method according to the present invention.

To set the glow temperature, control device 8 executes the following method indicated in FIG. 2 in the form of a flow chart.

In a step S1, the engine is started and the glow temperature is set to the maximum glow temperature such as 1400° C., for example, which means that the control device controls the heating pin accordingly. In a subsequent step S2, it is determined whether the engine has a specific temperature such as 80° C., following a warm start, or whether it has reached this temperature in the meantime, so that no (further) afterglowing is necessary and heating pin 7 is therefore deactivated or not triggered.

In a step S3, it is checked whether the internal combustion engine is in a defined operating state, e.g., no load running, in particular in a no load running state without charge pressure and without exhaust-gas recirculation and with a defined loading of the vehicle electric system, in order to keep the requested torque as low as possible. This operating state is advantageous because it corresponds to an operating state in which the lowest possible fuel quantity is injected. If the defined operating state is not present, then the method continues with step S2.

If the defined operating state is present or, according to a further specific development, if it was assumed during a specific time interval, then it is checked in step S4 whether a minimum glow temperature has been reached, such as 900° C., for example, at which the temperature is no longer able to affect the service life of the heating pin. If this is the case, then no further reduction of the afterglow temperature is necessary, and the method returns to step S2. Has the minimum glow temperature not been reached yet, then the method is continued with step S5.

In step S5, the glow temperature of heating pin 7 is reduced by a specific amount under the control of control device 8. This is done by reducing the voltage applied to heating pin 7 by control device 8. For example, the voltage for an exemplary heating pin may be reduced by 500 mV in order to induce a lowering of the glow temperature by approximately 50° C. The reduction of the afterglow temperature may take place in specified temperature steps or by a defined reduction of the voltage applied at the heating pin, or it may be achieved continuously at a specific gradient.

In a subsequent step S6, it is then determined whether an operating parameter is changing. More specifically, it is determined whether the closed-loop speed control of the engine detects a significant increase in the fuel quantity to be injected, or whether the fuel quantity to be injected does not change significantly despite the reduced glow temperature. As an alternative to the closed-loop speed control, it is also possible to utilize the control variable of a closed-loop torque control based on the cylinder pressure for detecting a change in the required injection quantity. Furthermore, as an alternative or in addition, it is possible to determine whether the smooth running of the engine worsens, by monitoring of the engine speed, for instance. Irregular running may also be detected by a direct measurement of the pressure inside the cylinder during the combustion, and by an evaluation of the pressure or torque fluctuations from combustion to combustion. If no change in the fuel quantity to be injected is detected by the closed-loop engine speed control, or no worsening of the smooth running, e.g., as a result of engine speed fluctuations or fluctuations in pressure or torque, then the method returns to step S4, and the glow temperature is reduced further for as long as the minimum glow temperature has not been reached yet. As an alternative, it is also possible to determine as operating parameter an engine run-up time which the engine requires to proceed from a specific initial engine speed to a specific final engine speed, based on no-load running of the engine. As a function of the run-up time, it is possible to determine whether or not operating parameters have changed as a result of the reduction of the afterglow temperature, for instance by a comparison with reference values.

In one specific embodiment, in step S6, a change in the fuel quantity during a specific time interval may be analyzed in order to infer an increase in the fuel quantity to be injected therefrom. This time period considers cycle and other delay times in the overall system and may amount to between 5 and 30 seconds, for instance, which may be between 10 to 15 seconds. During this time period the characteristic of the change in the fuel quantity to be injected is able to be analyzed as an alternative or in addition, and an excessive reduction of the afterglow temperature is already able to be inferred when an increase in the fuel quantity to be injected is detected, e.g., by checking whether the derivation of the fuel quantity characteristic shows a positive gradient.

Thus, even without an already considerable rise in the fuel quantity as a result of the method, a change due to the reduction of the afterglow temperature may already be detected early on, and in the event that a considerable increase in the fuel quantity to be injected is to be expected shortly or is to be expected in a further reduction of the afterglow temperature, it is possible not to reduce the afterglow temperature any further or to increase it again without this resulting in a considerable increase in the quantity of the injected fuel or in irregular running.

If it is determined in step S6 that the glow temperature is too low, i.e., by detecting an increase in the fuel quantity to be injected, for instance, which is detected by the closed-loop engine speed control, or by detecting irregular running, then the glow temperature is increased again in step S7, discretely or continuously, analogous to the reduction in step S5, in order to readjust the afterglow temperature to or above a glow temperature at which the internal combustion engine is able to be operated in optimal manner. As an alternative, information by which the extent of the increase can be determined may also be taken into account in step S7. For example, the change in the rotational speed or the quantity by which the fuel quantity to be injected has increased due to the latest reduction of the afterglow temperature.

The adaptation of the afterglow temperature in this method always takes place in a defined operating state, i.e., in no-load running of the engine, and is not used if the engine is in any other, not clearly definable operating state. However, in accordance with the set afterglow temperature, which was determined in the afore-described method, a correction value may be determined, which is applied to a corresponding characteristics map in control device 8 by which the afterglow temperature is set in other operating states.

Taken into account by the characteristics map are the cooling water temperature, the atmospheric pressure and the engine cycles following the startup of the engine, as well as the engine speed and the injection quantity of the fuel, and it supplies a voltage to be applied to the heating pin. The characteristics map typically does not consider constructional tolerances of the engine, the fuel quality or parameters of the overall system in which the engine is operated. Implementing the method for a specific period of time following the engine startup makes it possible to determine a corresponding correction value, by which the corresponding characteristics map is able to be modified in an effort to adaptively adjust the setting of the afterglow temperatures to the individual engine system in further operating states of the engine.

The method according to the present invention allows an adaptive setting of the afterglow temperature as a function of the fuel quality, the structural design and the tolerances of the engine and the overall system as well as the atmospheric pressure. No special adaptation as a function of the fuel quality and the atmospheric pressure is required. At the same time, the service life of the heating pin is extended since the glow temperature is reduced as soon as the engine operation allows it. Moreover, the fuel consumption is also reduced at a lower glow temperature because the generator has to provide less power to trigger the heating pin.

What is claimed is:

1. A method for setting an afterglow temperature in a self-igniting internal combustion engine, the method comprising:

determining, after start of the engine, if the internal combustion engine is in a predefined operating state which is a no-load-running state; and reducing the afterglow temperature in the predefined operating state of the internal combustion engine until a closed-loop engine speed control of the internal combustion engine detects a significant increase in the fuel quantity to be injected.

2. The method of claim 1, wherein, if an increase in the fuel quantity to be injected is required, the afterglow temperature is increased.

3. The method of claim 1, wherein the increase in the fuel quantity to be injected is estimated by determining a time gradient of the fuel quantity to be injected while the afterglow temperature is reduced, it being detected that an increase in the fuel quantity to be injected is required when the gradient exceeds a specific threshold value.

4. The method of claim 1, wherein it is detected that an increase in the fuel quantity to be injected is required when an average value of the fuel quantity to be injected across a specific time interval is greater than an average value of the fuel quantity to be injected across a time interval preceding the specific time interval.

5. The method of claim 1, wherein, following the start of the internal combustion engine, at least one of the following is satisfied: (i) the afterglow temperature is set to a maximum afterglow temperature, and (ii) the afterglow temperature is not reduced any further once a minimum afterglow temperature has been reached.

6. A device for setting an afterglow temperature for a self-igniting internal combustion engine, comprising:

a glow device, disposed on a cylinder, to provide a glow temperature inside the cylinder; and a control device configured to (i) provide a fuel quantity to be injected for operating the internal combustion engine, and (ii) reduce the afterglow temperature in a predefined operating state of the internal combustion engine after start of the engine until a closed-loop engine speed control of the control device detects an increase in the fuel quantity to be injected is required to maintain the predefined operating state, wherein the predefined operating state is a no-load-running state.

7. A non-transitory computer readable data storage medium storing a computer program having program codes which, when executed by a processor of a control device, performs a method for setting an afterglow temperature in a self-igniting internal combustion engine, the method comprising:

determining, after start of the engine, if the internal combustion engine is in a predefined operating state which is a no-load-running state; and reducing the afterglow temperature in the predefined operating state of the internal combustion engine until a closed-loop engine speed control of the internal combustion engine detects a significant increase in the fuel quantity to be injected.

* * * * *